United States Patent [19]

Holmberg

[11] Patent Number: 4,770,561

[45] Date of Patent: Sep. 13, 1988

[54] SHORELINE EROSION CONTROL DEVICES

[76] Inventor: Dick L. Holmberg, P.O. Box 100, Whitehall, Mich. 49461

[21] Appl. No.: 946,635

[22] Filed: Dec. 30, 1986

Related U.S. Application Data

[63] Continuation of Ser. No. 740,715, Jun. 3, 1985, abandoned.

[51] Int. Cl.[4] ..... E02B 3/04

[52] U.S. Cl. ..... 405/25; 405/28; 405/32

[58] Field of Search ..... 405/25, 28, 15, 21, 405/32, 34, 24, 23, 30, 26

[56] References Cited

U.S. PATENT DOCUMENTS

| | | | |
|---|---|---|---|
| 247,065 | 9/1881 | Knapp . | |
| 331,127 | 11/1885 | Goodridge, Jr. | 405/21 |
| 358,195 | 2/1887 | Griswold . | |
| 644,242 | 2/1900 | Combs . | |
| 752,637 | 2/1904 | Mankedick . | |
| 821,862 | 5/1906 | Depew . | |
| 867,802 | 10/1907 | Cottrell | 405/21 |
| 1,060,357 | 4/1913 | Nies | 405/32 |
| 2,662,378 | 12/1953 | Schmitt et al. | 405/32 |
| 3,226,737 | 1/1966 | Rote . | |
| 3,299,640 | 1/1967 | Nielsen . | |
| 3,373,568 | 3/1968 | Hornbostel, Jr. | 405/21 |
| 3,564,853 | 2/1971 | Csiszur | 405/32 |
| 3,590,585 | 7/1971 | DeWinter . | |
| 3,638,430 | 2/1972 | Smith . | |
| 3,670,504 | 6/1972 | Hayes et al. | 405/32 |
| 3,807,177 | 4/1974 | Oberg . | |
| 3,928,701 | 12/1975 | Roehner . | |
| 4,080,793 | 3/1978 | Pulsifer . | |
| 4,172,680 | 10/1979 | Brown . | |
| 4,221,500 | 9/1980 | Garrett . | |
| 4,374,629 | 2/1983 | Garrett . | |
| 4,437,786 | 3/1984 | Morrisroe . | |
| 4,478,533 | 10/1984 | Garrett . | |

FOREIGN PATENT DOCUMENTS

| | | | |
|---|---|---|---|
| 973373 | 8/1975 | Canada | 405/21 |

*Primary Examiner*—Randolph A. Reese
*Assistant Examiner*—Peter M. Cuomo
*Attorney, Agent, or Firm*—Price, Heneveld, Cooper, DeWitt & Litton

[57] ABSTRACT

An erosion control device for retarding shoreline erosion includes an elongated sheet with an elongated anchor extending along the elongated edges thereof to anchor the sheet to the sea bottom. A support located intermediate the elongated edges support the intermediate portions of the sheet above the sea bottom. The sheet has a plurality of openings located along the intermediate portions of the sheet to permit sand to accumulate under the sheet when the device is positioned underneath the water with the anchor anchoring the edges of the sheet to the sea bottom.

9 Claims, 5 Drawing Sheets

SHORELINE EROSION CONTROL DEVICES

This is a continuation of co-pending application Ser. No. 740,715, filed on June 3, 1985, now abandoned.

BACKGROUND OF THE INVENTION

The present invention relates to devices for arresting shoreline erosion.

Many structures designed to prevent shoreline erosion can actually accelerate it. Groins, for instance, structures which extend out into the water from the shore and several feet above the water surface, actually force the energy of waves hitting them downwardly against the sea bottom at the bases of the groins. Sand or other loose material at the bases generally wash away, and eventually such groins will lose support and fall or sink into the sea bottom.

Conventional seawalls generally fair no better because when waves hit the seawall, they are also directed downwardly to the sea bottom. Sand washes away at the base of the seawall, so the seawall will be undermined and fall into the water, losing whatever effectiveness it may have had as an erosion control device.

Both groins and seawalls often force currents (as opposed to waves) away from shore. Normally, currents carry sand toward shore, but when groins or seawalls deflect currents away from shore, sand in the currents is carried to deeper water and the shoreline is robbed of sand which might otherwise deposit there.

There are many construction problems in building groins and seawalls. Some groins and seawalls are made of concrete or rock which must be hauled to the construction site. Large trucks filled with concrete or rock can damage sensitive beach areas which are often protected by vegetation such as dune grass which is easily uprooted by trucks, exposing the beach or dune to wind erosion. As is well known, even when a relatively small area of dune vegetation is uprooted, winds can erode away an entire dune.

Some groins or seawalls can be constructed from sand-filled fabric bags (see, e.g., Hepworth U.S. Pat. No. 3,957,098, entitled EROSION CONTROL BAG issued May 18, 1976), and the sand required can be pumped from the sea bottom nearby. Pumping sand from the sea bottom is acceptable in many situations, but in certain environmentally sensitive areas, it is not recommended or permitted.

SUMMARY OF THE INVENTION

The shoreline erosion control device of the present invention includes an elongated sheet with anchor means extending along the elongated edges thereof to anchor the sheet to the sea bottom. Support means are positioned intermediate the elongated edges of the sheet for supporting the intermediate portion of the sheet above the sea bottom. The sheet has a plurality of openings through it located along the intermediate portions of the sheet such that when the device is positioned underneath the water with the anchor means anchoring the elongated edges of the sheet to the sea bottom, sand or other finely divided material along the sea bottom will enter the openings and become trapped underneath the sheet and support means, forming an elevated, elongated structure along the sea bottom to dissipate currents.

The erosion control device of the present invention is extremely lightweight since the sheet can be made of a permeable, fairly lightweight fabric while the support means can either be a float or an easy-to-construct wooden frame. Both types of structures eliminate the need for heavy construction equipment. Furthermore, both structures are self-filling so that there is no need to pump sand.

DETAILED DESCRIPTION OF THE PREFERRED EMBODIMENT

Figure 1:
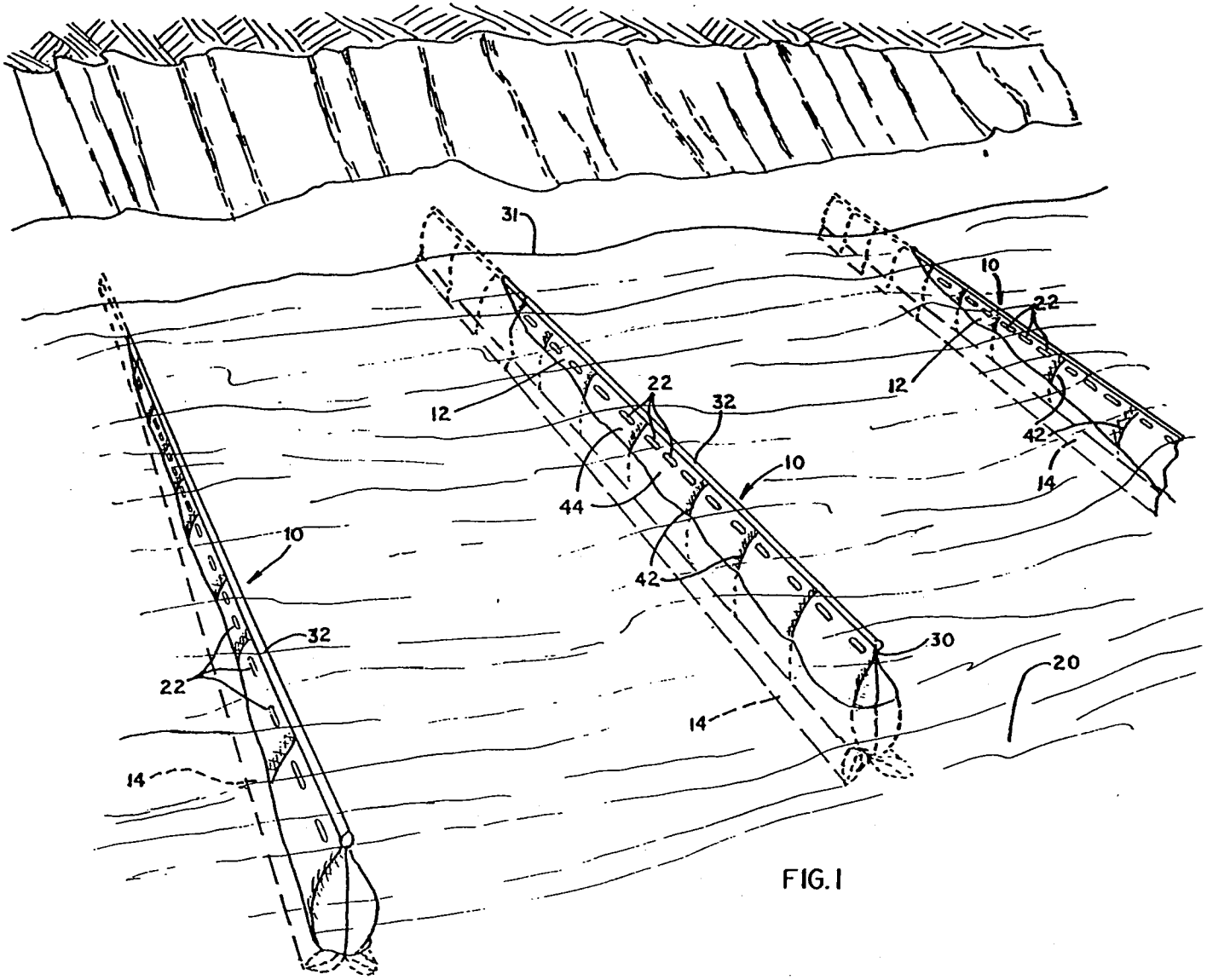
FIG. 1 is a perspective view of several erosion control devices of the present invention installed parallel to one another along the shoreline.

As shown in FIGS. 1–4, the shoreline erosion control device 10 of the present invention includes an elongated sheet 12 made of a permeable fabric with anchor means such as sand-filled pockets 14 and 16 secured along each of the elongated side edges of sheet 12. Support means such as float 18 is secured along the middle or intermediate portion of sheet 12 to hold the middle of the sheet above the seafloor 20 after the device is installed with the sand-filled pockets 14 and 16 anchoring the edges of the sheet beneath seafloor 20. Sheet 12, furthermore, has openings 22 located on either side of float 18 which capture sand and fill the empty device 10 shown in FIG. 3 to a full device illustrated in FIG. 4. This filling will take place automatically since the currents which carry sand will wash sand into openings 22 from which the sand cannot escape. The filled device is sufficiently massive such that currents running along shore will be dissipated by having to rise over the device. When a plurality of such devices are placed side by side, the eroding currents will be reduced in velocity to such an extent that sand will deposit, not erode.

Sheet 12 is made of a permeable fabric. Geotextile materials such as those sold under the trademark SUPAC by Philips Fibers Corporation are found to work well. Woven geotextiles are preferred.

Figure 4:
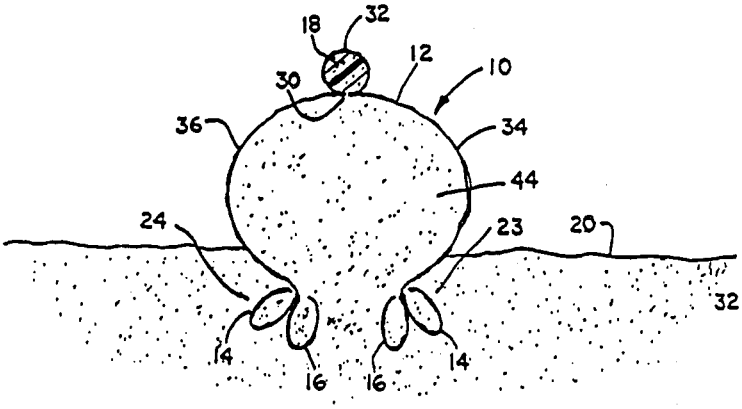
FIG. 4 is a cross section taken along the plane of line A—A of FIG. 2 after the device fills with sand.
Figure 7:
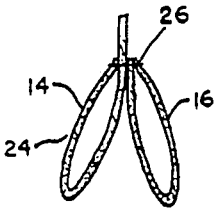
FIG. 7 is cross section taken along the plane of line VII—VII of FIG. 6.

Sheet 12 is anchored to the seafloor 20 by sand-filled pockets 14 and 16. As can be seen in FIGS. 3, 4 and 7, each of the two elongated edges 23 and 24 of sheet 12 has two pockets 14 and 16 attached to it. The pockets on the two elongated edges 23 and 24 are formed in the same fashion, so only one needs to be described in detail. As shown in FIG. 7, pocket 14 on edge 24 is formed simply by folding over the edge and stitching the edge to form a wide hem on pocket 14. Pocket 16 is formed by taking an elongated strip of fabric preferably made of the same material as sheet 12 and folding the fabric strip in half lengthwise and sewing the folded edges of the strip together to form pocket 16. Preferably, the edges of pocket 16 are placed against the back of sheet 12 and sewn simultaneously with the sewing of the hem to form pocket 14. Thus, the same stitches 26 which form pocket 14 are used to stitch the edges of pocket 16 and secure pocket 16 to sheet 12. Of course, other sewing methods can be used as well.

Figure 6:
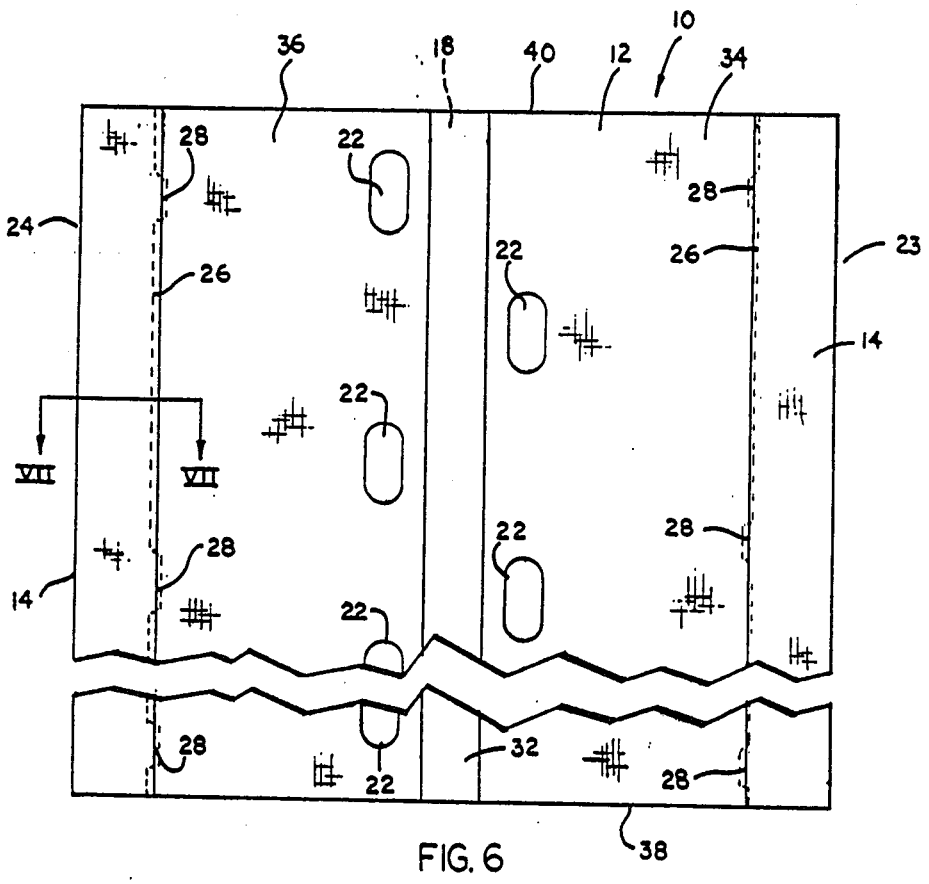
FIG. 6 is a plan view of a partially completed erosion control device of FIGS. 1–5 before installation along the shoreline.

Openings 28 are provided in pockets 14 and 16 to allow sand to enter pockets 14 and 16 as the device is being sewed by methods to be described below. Pocket openings 28 are formed by varying stitches 26 away from pockets 14 and 16 as the pockets are being sewn in selected locations about 5 feet apart along edges 23 and 24 of sheet 12 (FIG. 6). By providing openings 28 in pockets 14 and 16 adjacent the faces of sheet 12 to which pockets 14 and 16 are sewn, openings 28 will be oriented upwardly as shown in FIG. 3 when pockets 14 and 16 are installed in the sea bottom. Openings 28 in each pocket 14 or 16 are located every 5 feet apart and are each about 5–12 inches wide, this spacing and size having been found to be sufficient to permit pockets 14 and 16 to fill by themselves with sand during the water injection method installation described below.

Openings 28 can be as far as 10–15 feet apart. While openings 28 being 10–15 apart does allow pockets 14 and 16 to fill by themselves, the filling is not immediate, at least the filling which occurs during the water injection method installation is insufficent to anchor the device securely against strong currents. Therefore, if bad weather is expected shortly after installation, the device can be washed away if openings 28 are only 10–15 feet apart and supplemental sand is not injected or pumped into pockets 14 and 16 to supplement the sand which enters the pockets during installation.

Having openings 28 about 5 feet apart eliminates the need for supplemental sand injection. Even if currents are strong and begin to pull pockets 14 and 16 out of the sand before they are completely filled, the act of pulling the pockets out of the sand will cause openings 28 to open wide and scoop sand into pockets 14 and 16, further filling the pockets, making it difficult to remove pockets 14 and 16 from their anchorages.

Float 18 supports the central portion of sheet 12 above seafloor 20 because it is buoyant. Float 18 is secured along the middle of the sheet by sewing it into a central pocket 32 in sheet 12 formed by folding sheet 12 in half lengthwise and sewing stitches 30 parallel and close to the folded edge of sheet 12. Float 18 is then slid into the stitched central pocket, and the pocket ends are sewn closed to prevent float 18 from working free from pocket 32. Float 18 can be made of virtually any closed cell foamed polymeric material which is buoyant.

Openings 22 allow sand to fill underneath sheet 12 when the sheet is anchored along its elongated edges 22 and 24 by pockets 14 and 16 to the seafloor with float 18 supporting the middle portion of the sheet above the seafloor. Openings 22 are located in side portions 34 and 36 of sheet 12 on either side of and close to central pocket 32. When float 18 supports side portions 34 and 36 in the substantially vertical position, as shown in FIG. 3, the currents which flow transversely to the installed device will carry sand into openings 22 which fills the tunnel-like space 45 formed under sheet 12. Openings 22 on one side of central pocket 32 are staggered from the openings 22 on the other side of pocket 32 (see FIG. 6) to prevent sand from going into openings 22 on one side of the device and out openings 22 on the other side. Each opening 22 is about three inches by nine inches in area and spaced on three foot centers from adjacent openings 22.

Figure 3A:
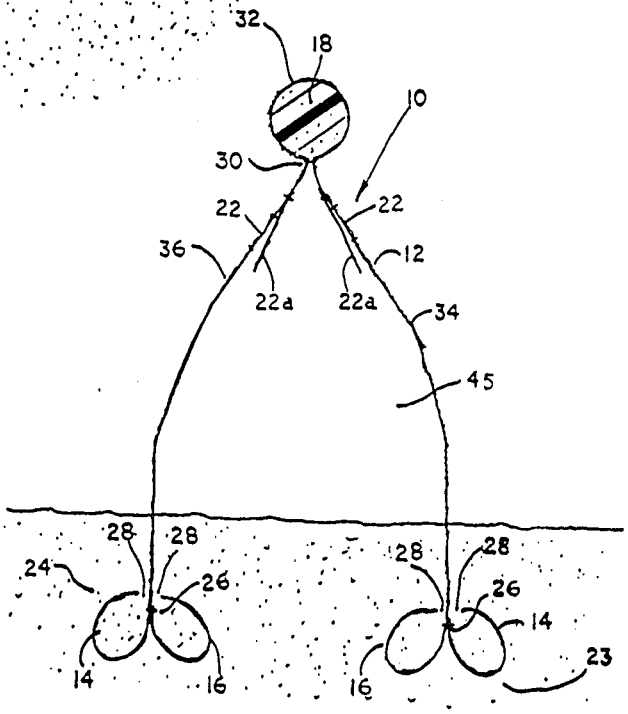
FIG. 3A is a cross section taken along the plane of line A—A of FIG. 2 illustrating a modified device before it fills with sand.
Figure 3:
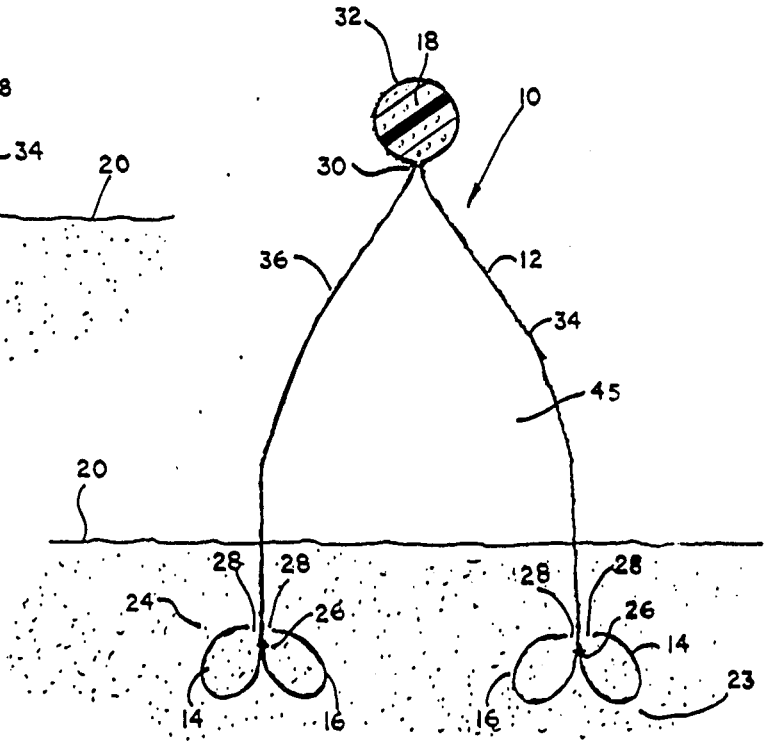
FIG. 3 is a cross section taken along the plane of line A—A of FIG. 2 immediately after the device is installed and before it fills with sand.

A modified device is shown in FIG. 3A where a flap **22*a* made of fabric is stitched above each opening 22, extending downwardly over and behind each opening 22. Flaps 22*a* allow sand to enter space 45 because currents will push flaps 22*a* away from openings 22 as water is forced into the device through openings 22. However, flaps 22*a* will close and cover openings 22 as water tries to force its way out of the device through openings 22, preventing sand from being washed out of space 45. Water will not be trapped in the device, however, because the fabric from which the device is made will allow water to percolate through it as water is forced into space 45 through openings 22**.

Figure 5:
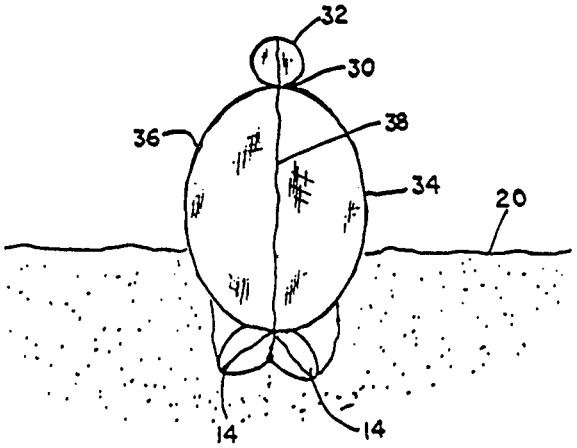
FIG. 5 is an end view of the erosion control structure of FIG. 2 taken along the plane of line V—V of FIG. 2.

The device so far described is shown in FIG. 6, but assembly of the device in FIG. 6 is incomplete. To complete it, the device is folded so that edges 23 and 24 overlay each other. Each end edge 38 and 40 of sheet 12 is thus folded over on itself and is stitched to close the ends of the device as shown in FIG. 5. In this way, the device has an inverted U-shaped cross-sectional shape as shown in FIG. 3 with the only openings into the device being through the bottom between the two pairs of side pockets on each elongated edge 23 and 24 and through openings 22 adjacent float 18.

As an alternate method of constructing erosion control device 12, the two side portions 34 and 36 on either side of float 18 can be made of separate elongated sheets of fabric (instead of one sheet 12) with a central pocket 32 sewn separately onto the mating edges of the two sheets, joining the two sheets together. It is not critical that the erosion control device be made of one sheet 12, it can be made of two elongated sheets sewn together at the point where float 18 is attached.

Optionally, a series of spaced, parallel, vertical stitches 42 (FIGS. 1 and 2) can be sewn to hold the two side portions 34 and 36 together Stitches 42, therefore, form subcompartments 44 which are isolated from one another. Thus, if one of the subcompartments is torn, other subcompartments will not lose sand.

With the construction of the device complete, it can be rolled or folded for transportation to the installation site where it can be unrolled or unfolded for installation by methods to be described.

Figure 2:
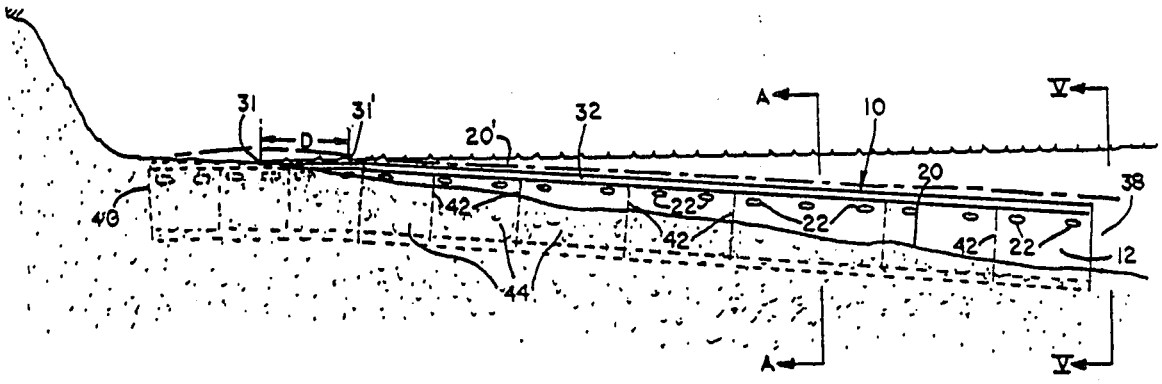
FIG. 2 is a side profile view of one of the erosion control devices illustrated in FIG. 1.

To install erosion control device 10, the device is unrolled, unfolded and positioned generally perpendicular to shore, as shown in FIGS. 1 and 2. To bury pockets 14 and 16, a water jet is directed against the sandy bottom 20. When a water jet is directed against the sandy seafloor, it liquifies the sand on the seafloor adjacent the nozzle. Pockets 14 and 16 can be pushed downwardly into the liquified sand, pushing one elongated edge into the sand at a time. To get one edge into the sand, one starts at one end of the device with a nozzle and moves toward the other end, pushing the one edge into the sand with its two pockets 14 and 16 as one proceeds along the length of the device. The procedure is then repeated for the other edge 24 starting at one end of the device and moving toward the other. Care should be taken to space the two edges 23 and 24 from each other, as shown in FIG. 3. This creates a tunnel-like space 45 in which sand can be trapped after it falls through openings 22.

When the edges are pushed into the sand liquified by the water jet, sand enters pockets 14 and 16 through openings 28. Usually, the amount of sand that gets into pockets 14 and 16 through openings 28 in this fashion is sufficient to prevent the device from floating to the surface under the buoyancy of float 18, even though pockets 14 and 16 on each edge 23 and 24 may not be completely filled with sand at first. One can pump sand directly into pockets 14 and 16 by inserting a sand pump nozzle into openings 28 before or after pockets 14 and 16 on each edge 23 and 24 are pushed into the sand. The amount of sand pumped into the pockets 14 and 16 is quite small and does not disrupt the seafloor very much. If sand pumping is not desired, however, it has been found that openings 28 will actually allow pockets 14 and 16 to fill completely by themselves over time after the pockets have been inserted into the sand by the water jet injection method described above.

The positioning of the device is quite important. As shown in FIG. 2, the device should be located completely underneath the water surface. To this end, the device may have to be positioned deeper into the seafloor closer to shore, as shown in FIGS. 1 and 2, to prevent float 18 from breaking the surface. Furthermore, in areas where the currents exceed the velocity where sand will be entrained by the currents, the device should be sufficiently far below the water surface to force the currents to move gently over the device rather than being deflected away from shore. When the currents are allowed to pass over the device, the currents lose their energy, their velocity is reduced, and any sand that the currents carry is deposited, instead of being entrained.

If, on the other hand, the device were positioned so that it would break the water surface or positioned such that it would be even with the water surface, it would deflect currents and waves away from shore after it was filled with sand. When currents are deflected away from shore, the sand entrained in the currents is carried away from shore and robs the shore of sand which might otherwise deposit there.

If the device is positioned such that it extends into waters where the currents exceed the erosion velocity where sand is entrained and is located in those areas such that it remains sufficiently below the water surface to allow the currents to move gently over the device, the currents' velocities will be reduced because the kinetic energies of the currents will be attenuated by the currents having to rise over the erosion control structures. In fact, a series of parallel erosion control devices 10 should be placed along the shoreline perpendicular to the shoreline, as shown in FIG. 1. With the devices placed parallel to one another and sufficiently below the surface of the water, sand will not only fill the tunnel spaces 45 within each device 10, as shown in FIG. 4, but sand will deposit between and around the parallel devices 10 and eventually bury the devices. Thus, a new sea bottom profile 20' (FIG. 2) is formed. Thus, the sea bottom is raised from its original position 20 to a new position 20', advancing the beach a distance D from its original position. Thus, shoreline will accrete.

To force the shoreline to retreat even further, a second set of parallel devices can be positioned with each device perpendicular to shore and spaced from other devices. The second set of devices is placed in relationship to the new shoreline 31' in the same fashion the original devices were placed in relationship to the old shoreline 31 (FIG. 2). Again, the new devices are positioned so they extend into water where currents exceed the velocity where sand will be entrained, and are positioned sufficiently below the surface of the water such that the currents are forced to rise gently over the devices instead of deflecting off the devices. Each of the second devices can be positioned intermediate two of the original devices to allow each of the new devices to be buried sufficiently deeply into the sand without running into the old devices now buried.

As shown in FIGS. 1 and 2, erosion control device 10 should extend under the beach to a point above the waterline 31 where water cannot wash around the end of device 10 above the waterline. Two things are avoided with this practice: waves washing away beach during high water periods and currents being directed onto the beach by a series of such devices placed parallel to each other and perpendicular to shore.

As shown in FIGS. 1 and 2, the devices are positioned perpendicular to shore. It is also possible to position them parallel to shore and to each other to form a series of artificial sandbars. If the devices are placed parallel to shore, they must also be positioned underneath the water surface sufficiently to allow waves and currents to gently roll over the devices, thereby attenuating the strength of these waves.

A modified erosion control device 50 is illustrated in FIGS. 8–14. The modified device 50 includes an elongated sheet 52 which is anchored along its elongated edges by pockets 54 and 56 to the seafloor 60. The intermediate portion of the sheet is supported above seafloor 60 by an elongated wooden frame 58. A cap 62 is placed over the frame after sheet 52 has been draped over the frame. Openings 63 through cap 62 and sheet 52 along the top of the structure 50 allow sand either to be pumped into the device or to deposit in the device as currents gently move over the device. Thus, the device will fill from an empty state (illustrated in FIG. 11) to a full state (illustrated in FIGS. 12 and 13). When filled, device 50 creates a sufficiently massive structure that currents can be dissipated.

Figure 8:
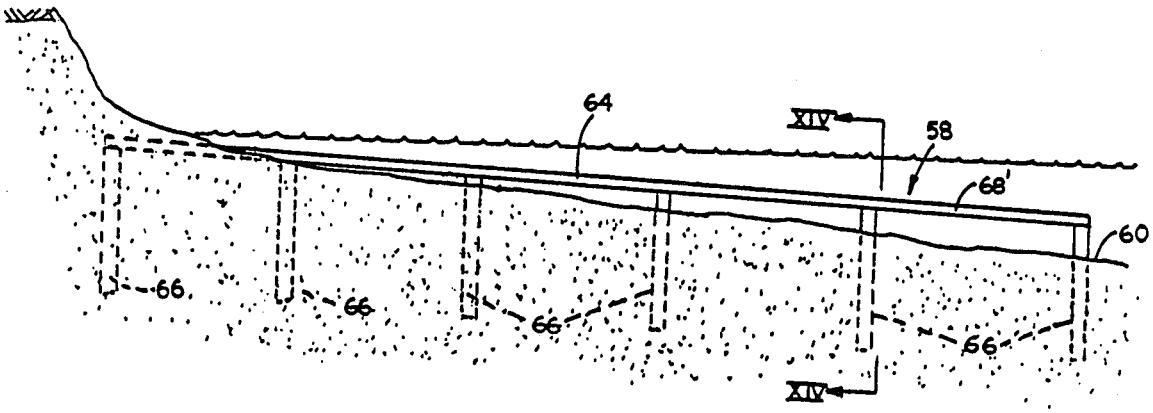
FIG. 8 is a side elevation of a frame used to support a modified erosion control structure of the present invention.
Figure 9:
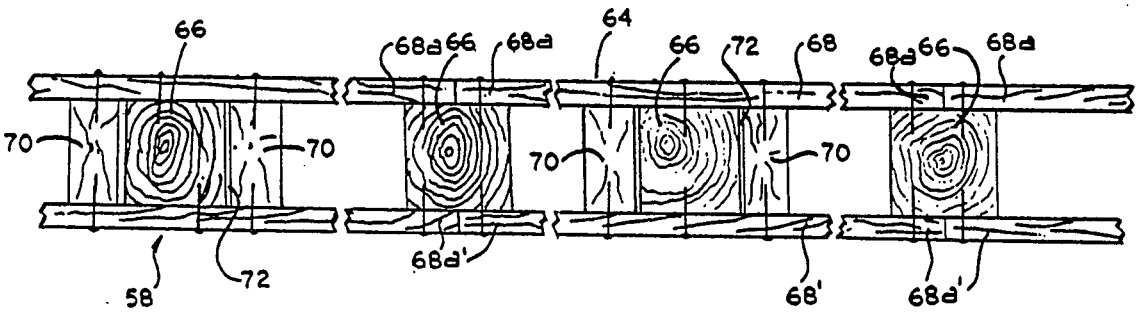
FIG. 9 is a partially broken, top elevation of the frame of FIG. 8.
Figure 10:
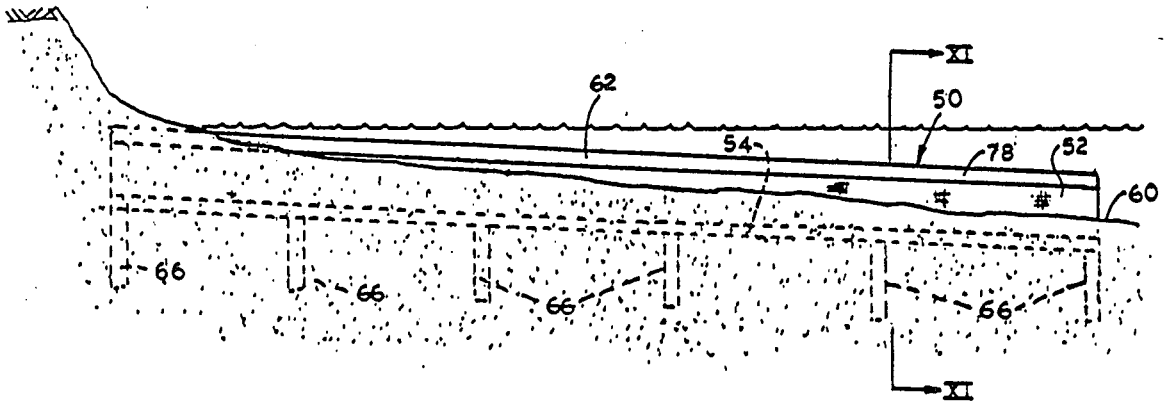
FIG. 10 is a completed, modified erosion control device of the present invention utilizing the frame illustrated in FIGS. 8 and 9.
Figure 14:
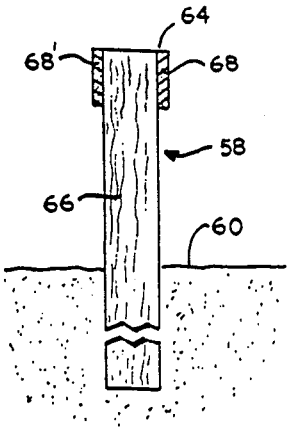
FIG. 14 is a cross section taken along the plane of line XIV—XIV of FIG. 8.

Frame 58 is illustrated in FIGS. 8, 9 and 14. Frame 58 includes a rail 64 which is supported above ocean floor 60 on a series of posts 66 which are driven into the seafloor and extend upwardly from it. Rail 64 includes two elongated side rail members 68 and 68'. Rail members 68 and 68' are secured together and held parallel to one another before being secured to posts 66 by being nailed to spacers 70 placed between rail members 68. Spacers 70 are positioned in pairs along and between rail members 68, 68'. Each pair of spacers 70 is positioned along rail members 68, 68' where a post 66 is to be located. Furthermore, each spacer 70 in each pair is spaced from its paired spacer a distance corresponding to the width of a post 66 to form an opening 72 (FIG. 9)

to receive a post 66 between the two paired spacers and the two rail members 68, 68'.

Spacers 70 are not used on each side of each post 66. The rail members 68 and 68' are made of a plurality of board lengths 68*a* or 68*a'*. Where two adjacent boards 68*a* or 68*a'* are to be joined together, a post is positioned at the juncture of the two boards (FIG. 9) and the boards are nailed directly to the post, the post thereby joining the two boards together.

To assemble the frame, the rail members 68 and 68' spaced by spacers 70 are floated along the water surface above the position where they will be when installed. The spaced rail members are then lowered to the positions under the water where they will be held and fastened to posts 66. Then, using a water jet directed into the sand along the bottom 60, posts 66 are inserted one at a time into the sand through openings 72 with the water jet agitating the sand immediately below openings 72 so that posts 66 can be pushed downwardly into the sand. After posts 66 are driven to a sufficient depth into the sand, rail members 68 are nailed to posts 66. At the junctures of boards 68*a* and 68*a'*, the same process is repeated using the water jet to liquify sand along the seafloor below the junctures of the boards. The posts are pushed into the liquified sand at the junctures of the boards and then the adjacent boards 68*a* and 68*a'* are nailed to the posts 66 positioned at the junctures. The procedure of using water jets to liquify the sandy seafloor and pushing the posts into the liquified sand is repeated along the length of rail 64 until all of the posts are properly positioned along the length of rail 64 and inserted to the desired depth.

Each post 66 is approximately 10–12 feet long, and at least 50% of each post must extend into the sandy bottom. Driving the posts at least 5–6 feet into the bottom has been found to be sufficient to securely anchor the structure to the seafloor. Furthermore, the posts should be 10 feet apart.

Figure 13:
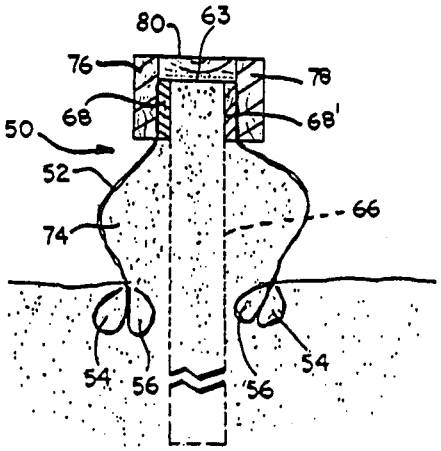
FIG. 13 is a cross section taken along the plane of line XIII—XIII of FIG. 12.

After frame 58 is constructed, sheet 52 is draped over the frame. Sheet 52 is an elongated piece of fabric with pockets 54 and 56 sewn along each elongated edge of the elongated sheet. Pockets 54 and 56 are identical to pockets 14 and 16 described above, so no further description is necessary. However, the intermediate portion of sheet 52 differs from the intermediate portion of sheet 12 in several respects. First, no float is provided since frame 58 is used to support the intermediate portion of sheet 52 above seafloor 60. Second, openings 28 are not provided on either side of frame 58. Instead, openings 63 (FIGS. 12 and 13) are cut in sheet 52 after cap 62 has been placed over rail 64. Third, no vertical stitches 42 are sewn along sheet 52. Only the end edges of sheet 52 are sewn to close the ends of the sheet and to create one long continuous compartment 74 underneath the sheet and below rail 64 which fills with sand, as shown in FIG. 13.

Figure 11:
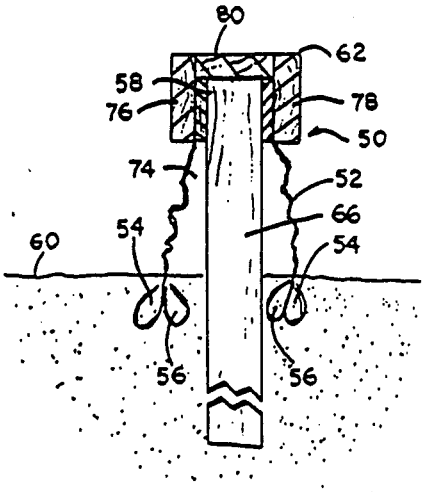
FIG. 11 is a partially broken cross section view taken along the plane of line XI—XI of FIG. 10.
Figure 12:
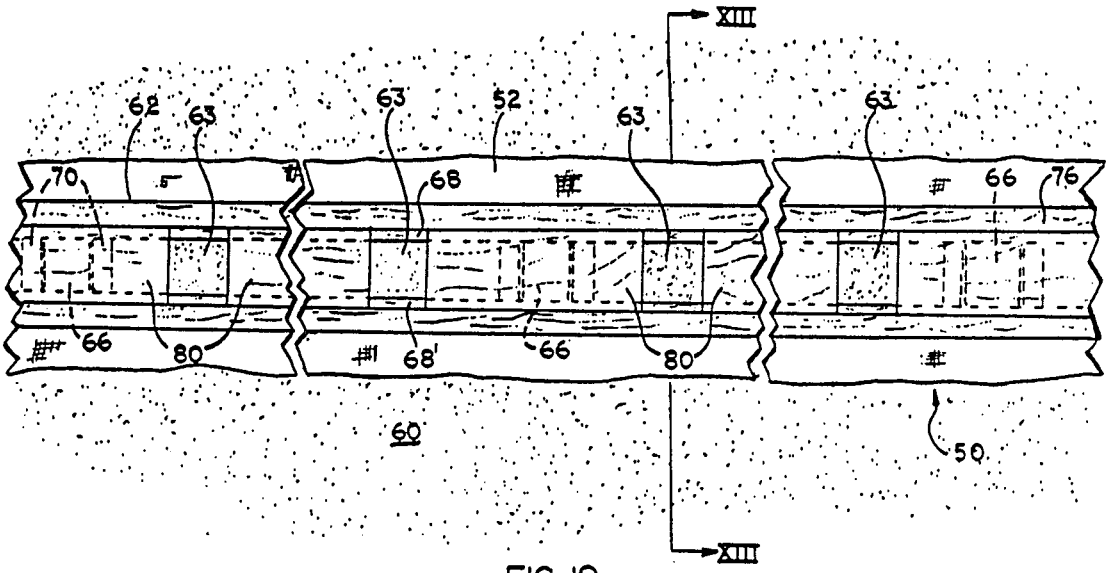
FIG. 12 is a partially broken top plan view of the erosion control device of FIG. 10 after it is filled with sand.

Cap 62 includes two side cap members 76 and 78 joined by a top cap member 80. Side cap members 76 and 78 are continuous in that they are each made of a plurality of boards placed end to end in abutting relationship along the entire length of erosion control device 50. Top cap member 80, however, is not continuous and is made of short pieces of lumber spaced from each other to form openings 63 through the top of erosion control device 50 (FIG. 12). Thus, side cap members 76 and 78 and top cap member 80 form an inverted U-shaped cap which has openings 63 through the top of the inverted U (FIGS. 11 and 13).

Cap 62 is placed over rail 64 and sandwiches the middle of sheet 52 between itself and rail 64. After cap 62 is placed over rail 64, it can be nailed to rail 64 to hold it in place. After cap 62 is nailed in place, openings 63 in sheet 52 can be cut to allow sand to fill compartment 74.

Erosion control device 50 is positioned underneath the water surface similar to the position of erosion control device 10 described above. Modified device 50 is positioned so that it does not extend above the water surface and remains sufficiently below the water surface in areas where the currents exceed erosion velocities such that the currents will not deflect off of the device but, rather, gently flow over the device. The currents must be dissipated, not diverted away from shore so that the sand will deposit near shore not be carried toward deeper water. Also, device 50 extends under the beach above the waterline to prevent currents from around the device over the beach during high water periods.

The advantage of the modified device is that cap 62 and frame 58 will protect sheet 52 from floating debris such as logs and the like which can rip sheet 52 and allow sand to escape after the device is filled with sand. Instead, any floating debries will hit cap 62, so there is no need to compartmentalize the device by stitches 42, as is the case in device 10.

It should be apparent that the devices disclosed are not designed like conventional seawalls and groins to be structurally strong enough to stop currents and waves. The devices of the present invention dissipate currents and waves, attenuating their energy, so it is unnecessary to emphasize long-term durability against wave and current action. These devices are low-cost effective erosion control measures which restore beaches to more natural contours that effectively arrest shoreline erosion. These devices eventually become buried, leaving the higher beach profiles as a bulwark against erosion, obviating the expense and ultimate futility of constructing groins and seawalls with long-term durability.

While two embodiments of the invention have been disclosed, other embodiments of this invention will become apparent to those of ordinary skill in the art. These additional embodiments are to be included within the scope of the present invention unless the claims which follow expressly state otherwise.

The embodiments of the invention in which an exclusive property or privilege is claimed are defined as follows:

1. A shoreline erosion control device for installation along the sea bottom, comprising:

(a) an elongated sheet having elongated edges and intermediate portions between said edges with anchor means extending along said elongated edges thereof to anchor and bury said elongated edges of said sheet in the sea bottom, said sheet having a weave size;

(b) support means intermediate said elongated edges for supporting said intermediate portions of said sheet above the sea bottom, said support means adapted to support said intermediate portions depend therefrom with sufficient slack to provide for divergent lateral movement of said intermediate portions, said support means including an elongated frame with legs to be extended into said sea bottom, said frame to support said intermediate portions above said bottom; and (c) a plurality of openings therethrough located along said intermediate portions of said sheet and greater in size than any weave of said sheet;

whereby said device is positioned underneath the water with said anchor means anchoring the elongated edges of said sheet to the sea bottom and with said support means elevating the intermediate portions of said sheet above the bottom so that sand carried by currents will enter said plurality of openings and become trapped under said sheet and support means, said intermediate portions divergently laterally moving as sand is trapped thereunder forming an elevated, elongated structure along the sea bottom to dissipate currents.

2. The shoreline erosion control device as recited in claim 1 wherein said anchor means comprises at least one elongated pocket extending along each of said elongated edges, said pocket being filled with a weighted material.

3. The shoreline erision control device as recited in claim 2 wherein a plurality of pocket openings are included along the length of each of said pockets, said pockets forming junctures with said sheets and said pocket openings being located along said junctures of said pockets with said sheets.

4. The shoreline erosion control device as recited in claim 3 wherein said pockets comprise hems sewn along the elongated edges of said sheet.

5. The erosion control device as recited in claim 3 wherein two of said pockets are secured on each elongated edge of said sheet.

6. The shoreline erosion control device as recited in claim 1 wherein said sheet is made of a permeable fabric.

7. A shoreline erosion control device for installation along the sea bottom, comprising:

(a) an elongated sheet having elongated edges and intermediate portions between said edges with anchor means extending along said elongated edges thereof to anchor and bury said elongated edges of said sheet in the sea bottom;

(b) support means intermediate said elongated edges for supporting said intermediate portions of said sheet above the sea bottom, said support means adapted to support said intermediate portions such that said intermediate portions depend therefrom with sufficient slack to provide for divergent lateral movement of said intermediate portions, said support means including an elongated frame with legs to be extended into said sea bottom, said frame to support said intermediate portions above said bottom and said sheet draped over said frame, said frame further including an elongated cap placed over and along said frame to sandwich a part of said intermediate portion between said frame and cap;

(c) a plurality of openings therethrough located along said intermediate portions of said sheet;

whereby said device is positioned undreneath the water with said anchor means anchoring the elongated edges of said sheet to the sea bottom and with said support means elevating the intermediate portions of said sheet above the bottom so that sand carried by currents will enter said plurality of openings and become trapped under said sheet and support means, said intermediate portions divergently laterally moving as sand is trapped thereunder forming an elevated, elongated structure along the sea bottom to dissipate currents.

8. The shoreline erosion control device as recited in claim 7 wherein said intermediate portion openings are located under said cap, and said cap has a plurality of openings located and aligned over said intermediate portion openings.

9. A shoreline erosion control device for installation along the sea bottom, comprising:

(a) an elongated sheet having elongated edges and intermediate portions between said edges with anchor means extending along said elongated edges thereof to anchor and bury said elongated edges of said sheet in the sea bottom, said anchor means comprising at least one elongated pocket extending along each of said elongated edges, said pocket being filled with a weighted material, and a plurality of pocket openings included along the length of each of said pockets, said pockets forming junctures with said sheets and said pocket openings being located along said junctures of said pockets with said sheets;

(b) support means intermediate said elongated edges for supporting said intermediate portions of said sheet above the sea bottom, said support means adapted to support said intermediate portions such that said intermediate portions depend therefrom with sufficient slack to provide for divergent lateral movement of said intermediate portions, said support means including an elongated frame with legs to be extended into said sea bottom, said frame to support said intermediate portions above said bottom and said sheet draped over said frame, said frame further including an elongated cap placed over and along said frame to sandwich a part of said intermediate portion between said frame and cap;

(c) a plurality of openings therethrough located along said intermediate portions of said sheet;

whereby said device is positioned underneath the water with said anchor means anchoring the elongated edges of said sheet to the sea bottom and with said support means elevating the intermediate portions of said sheet above the bottom so that sand carried by currents will enter said plurality of openings and become trapped under said sheet and support means, said intermediate portions divergently laterally moving as sand is trapped thereunder forming an elevated, elongated structure along sea bottom to dissipate currents.

* * * * *

UNITED STATES PATENT AND TRADEMARK OFFICE

CERTIFICATE OF CORRECTION

PATENT NO. : 4,770,561

DATED : September 13, 1988

INVENTOR(S) : Dick L. Holmberg

It is certified that error appears in the above-identified patent and that said Letters Patent is hereby corrected as shown below:

Column 8, Claim 1, Line 63:
After "portions" insert --such that said intermediate portions--.

Column 9, Claim 3, Line 21:
"erision" should be --erosion--.

Column 10, Claim 7, Line 1:
"undreneath" should be --underneath--.

Signed and Sealed this

Twenty-first Day of March, 1989

*Attest:*

*Attesting Officer*

DONALD J. QUIGG

*Commissioner of Patents and Trademarks*